US006688227B2

(12) United States Patent
Zerillo

(10) Patent No.: US 6,688,227 B2
(45) Date of Patent: Feb. 10, 2004

(54) MAGNETIC PLATE-RETENTION SYSTEM AND METHOD OF SECURING RECORDING MEDIUM TO ROTATABLE SUPPORT

(75) Inventor: Samuel D. Zerillo, Hillsboro, NH (US)

(73) Assignee: Presstek, Inc., Hudson, NH (US)

( * ) Notice: Subject to any disclaimer, the term of this patent is extended or adjusted under 35 U.S.C. 154(b) by 0 days.

(21) Appl. No.: 10/113,277

(22) Filed: Apr. 1, 2002

(65) Prior Publication Data

US 2003/0183102 A1 Oct. 2, 2003

(51) Int. Cl.[7] ..... B41F 27/02

(52) U.S. Cl. ..... 101/389.1; 101/415.1; 101/378; 271/275

(58) Field of Search ..... 101/415.1, 389.1, 101/378, 409, 382.1, 383, 385, 386, 477; 271/275, 277, 193

(56) References Cited

U.S. PATENT DOCUMENTS

| | | | | |
|---|---|---|---|---|
| 3,438,324 A | * | 4/1969 | Meade | 101/378 |
| 3,506,779 A | | 4/1970 | Brown | |
| 3,581,257 A | | 5/1971 | Priessnetz | 335/285 |
| 3,670,646 A | | 6/1972 | Welch, Jr. | 101/382 |
| 4,054,094 A | | 10/1977 | Caddell et al. | 101/467 |
| 4,138,102 A | | 2/1979 | Palmer | 271/3 |
| 4,347,785 A | | 9/1982 | Chase et al. | 101/1 |
| 4,402,265 A | | 9/1983 | Pickard | 101/382 |
| 4,528,906 A | | 7/1985 | Hasegawa | 101/127.1 |
| 4,587,900 A | | 5/1986 | Oshio | 101/382 |
| 4,744,297 A | | 5/1988 | Sardella et al. | 101/382 |
| 4,890,553 A | | 1/1990 | Turner | 101/389 |
| 4,911,075 A | | 3/1990 | Lewis et al. | 101/453 |
| 5,111,744 A | | 5/1992 | Wieland | 101/216 |
| 5,385,092 A | | 1/1995 | Lewis et al. | 101/467 |
| 5,555,812 A | | 9/1996 | Ruckmann et al. | 101/477 |
| 5,627,505 A | | 5/1997 | Iwaszek | 335/302 |
| 5,685,226 A | | 11/1997 | Fuller | 101/415.1 |
| 5,797,323 A | | 8/1998 | Beck | 101/389.1 |
| 6,457,410 B1 | * | 10/2002 | Zerillo | 101/389.1 |

* cited by examiner

*Primary Examiner*—Leslie J. Evanisko
(74) *Attorney, Agent, or Firm*—Testa, Hurwitz & Thibeault, LLP

(57) ABSTRACT

A magnetic plate retention system especially suitable for use in retaining a lithographic plate material to a conventional plate cylinder utilizes one of more elongated retention devices selectively positioned anywhere along the outer circumferential surface of the plate cylinder parallel to the axis of rotation of the cylinder. The retention devices are applied, removed, and retained with an application/removal assembly.

22 Claims, 20 Drawing Sheets

MAGNETIC PLATE-RETENTION SYSTEM AND METHOD OF SECURING RECORDING MEDIUM TO ROTATABLE SUPPORT

BACKGROUND OF THE INVENTION

1. Field of the Invention

This invention relates generally to clamping systems and methods and more particularly to claiming systems and methods for releasably securing a printing plate to a plate cylinder.

2. Description of the Related Art

In offset lithography, an image is present on a printing plate as a pattern or "image" of ink-accepting (oleophilic) and ink-repellent (oleophobic) surface areas. In a typical sheet-fed offset press system, the imaged plate is mounted to a plate cylinder, where it is inked. The plate is then brought into contact with the compliant surface of a blanket cylinder. The blanket cylinder, in turn, applies the image to paper sheets which are brought into contact with the blanket cylinder by an impression cylinder.

Although the plates for an offset press were traditionally imaged photographically, more recently, a number of electronic alternatives have been developed for placing the image onto the plate. These digitally controlled imaging devices include lasers that chemically alter or destroy one or more plate layers, ink jets that directly deposit ink-repellent or ink-accepting spots on a plate blank and spark or ion discharge devices which physically alter the topology of the plate blank. These various methods of imaging lithographic plates are described in detail in U.S. Pat. Nos. 3,506,779, 4,054,094, 4,347,785, 4,911,075 and, 5,385,092 among others.

Plates can be imaged on-press or, more traditionally, on an off-press platesetter. A digitally operated platesetter includes an imaging cylinder to which the plate is initially mounted, and which carries the plate past the head of the imaging device. That device transfers the image to the plate. The imaged plate is then removed from the platesetter and transferred to the plate cylinder of the printing press.

When mounting an imaged plate to a plate cylinder for a press run or when mounting a plate blank to an imaging cylinder for imaging, it is essential that the leading and trailing edges of the plate be secured firmly to the cylinder and that the plate be wrapped tightly around the cylinder. This ensures that there will be no relative movement between the plate and the cylinder when the cylinder is rotated. Likewise, when a donor/acceptor sheet set is mounted to a cylinder for platemaking by thermal transfer, both sheets must be firmly clamped to the plate to avoid relative movement.

Various devices, including vacuum clamps and mechanical and electromechanical clamps, have been developed over the years for holding a lithographic plate to a plate cylinder. For the most part, theses devices have all tended to be relatively complex and costly. Such devices typically require relatively large and heavy metal plates as components of the clamping mechanism which, when attached to the plate cylinder, create a substantial "void" segment on the cylinder. Also, in most cases, the clamping mechanisms are fixed to the cylinders such that the mechanisms can only secure a printing plate having a specific length. Since the plate blanks are often pre-cut to fit the specific plate cylinder of the printing press, a separate imaging cylinder, having the same dimensions as the printing cylinder, is generally used to image the plates associated with each printing press. The inability of platesetter and printing cylinders to accommodate differently sized plates substantially increases the cost of operating the printing press.

DESCRIPTION OF THE INVENTION

Brief Summary of the Invention

The present invention enables rapid, efficient mounting of a recording member, such as a lithographic plate to a plate cylinder for printing. It is equally applicable for securing a plate blank or a donor/acceptor sheet for plate-making.

Briefly, the invention utilizes one or more retention devices each having a plurality of discrete magnetic elements separated by interstitial spaces. The retention devices are removed from and disposed onto a cylinder-borne plate by an application/removal system configured to engage the retention devices. When disposed on the plate, the retention devices magnetically adhere the plate to the underlying cylinder.

It is an object of the present invention to provide rapid, efficient mounting of a recording member such as a lithographic plate to a cylinder for printing. It is equally advantageous for mounting a plate blank or a donor/acceptor sheet set to a cylinder for plate-making.

It is a further object of the present invention to provide a plate clamping system to easily accommodate plates of varying sizes.

Accordingly, in a first aspect, an apparatus for securing a recording medium to a rotatable supporting means in accordance with the invention comprises an elongated retention device for releasable attachment to the supporting means over the recording medium, and comprising at least one magnetic element; and an application/removal device for holding and dispensing the retention device. The application/removal device is positionable with respect to the supporting means to facilitate dispensing and removal of the retention device. In various embodiments, when the application/removal device holds the retention device, rotation of the supporting means in a first direction causes the retention device to be dispensed onto the supporting means so as to secure the recording medium thereto, and when the retention device is attached to the supporting means, rotation of the supporting means in a second direction causes the application/removal device to strip the retention device from the supporting means. In preferred embodiments, the application/removal device has a plurality of projections for engaging the interstitial spaces of the retention devices. The application/removal device may also advance toward or away from the supporting means. In a second aspect, the invention comprises a method for securing a recording medium to a rotatable supporting means comprising at least a magnetically susceptible surface. An application/removal device and an elongated retention device having at least one magnetic element is provided.

The foregoing and other objects, features and advantages of the present invention disclosed herein, as well as the invention itself, will be more fully understood from the following description of preferred embodiments and claims, when read together with the accompanying drawings. In the drawings, like reference characters generally refer to the same parts throughout the different views. The drawings are not necessarily to scale, emphasis instead generally being placed upon illustrating the principles of the invention.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1:
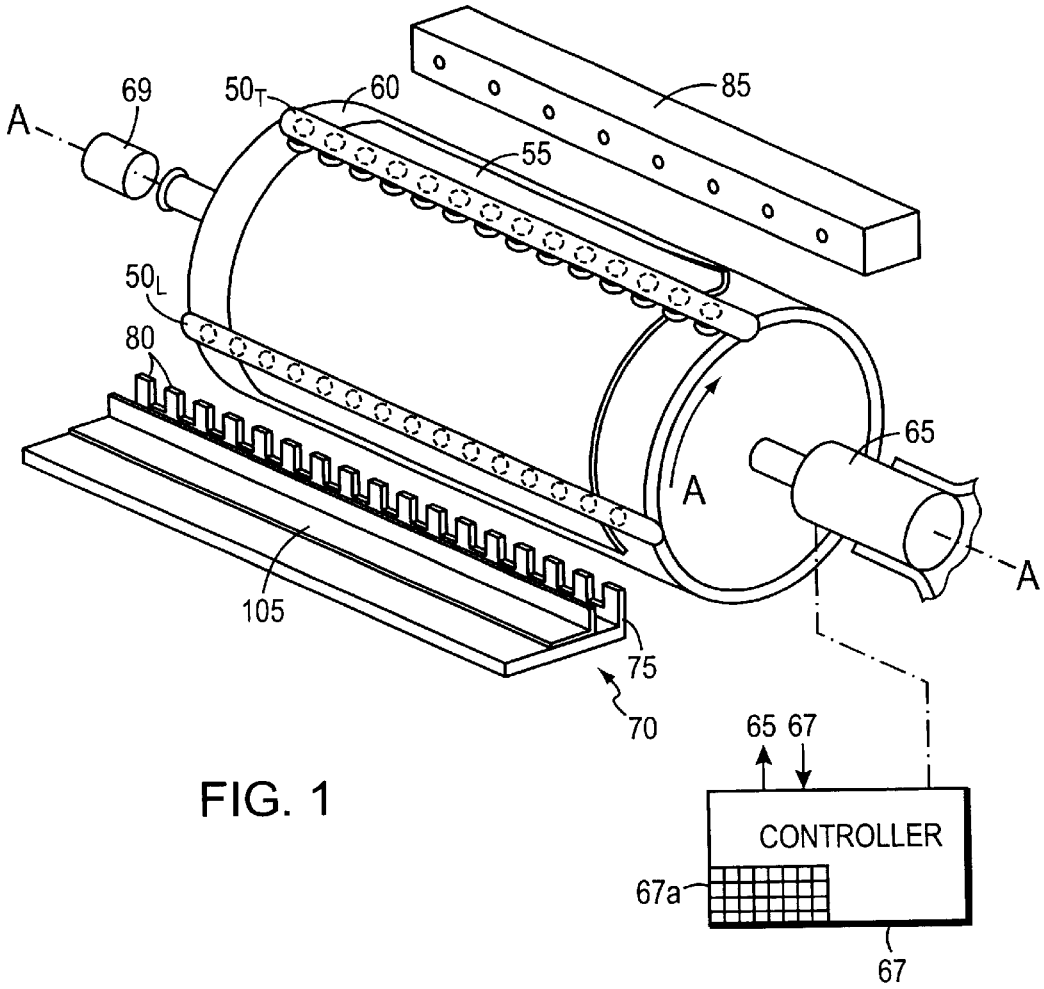
FIG. 1 is a schematic isometric view of the magnetic plate-retention system in accordance with the invention.
Figure 3:
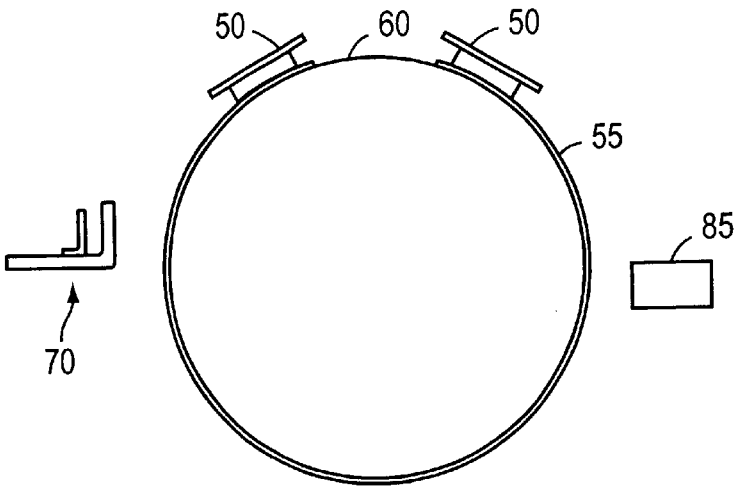
FIG. 3 is a side schematic elevation of the magnetic plate-retention system in accordance with the invention.
Figure 2:
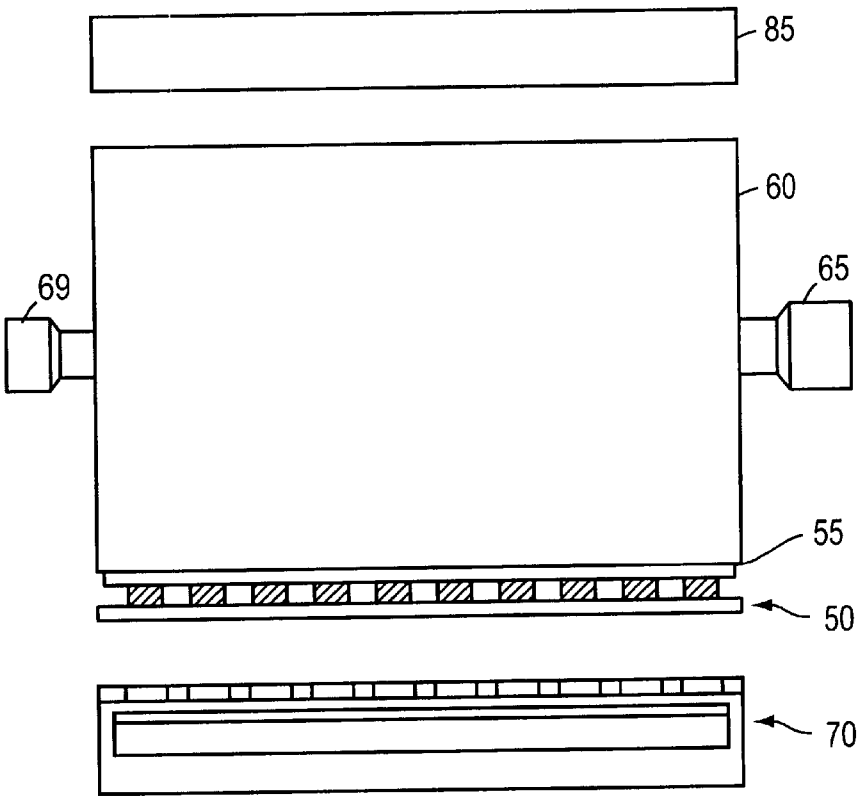
FIG. 2 is a front schematic elevation of the magnetic plate-retention system in accordance with the invention.

With reference to FIGS. 1, 2, and 3, a magnetic retention system in accordance with the invention comprises one or more elongated retention devices 50 for retaining, in one embodiment, a printing plate 55 wrapped around the outer surface of a plate cylinder 60. The plate cylinder 60 rotates about longitudinal axis A—A in the direction of the arrow A by a cylinder motor 65 under the control of a programmable controller 67 having a user input device 67*a* for entering instructions therein. The controller 67 may receive signals from a shaft encoder 69 coupled to plate cylinder 60 opposite the cylinder motor 65 which enables the controller 67 to monitor and set at selected positions the angular position of plate cylinder 60 about its axis of rotation A—A. Cylinder 60 may be part of a printing, imaging or proofing apparatus and is arranged to support a flexible sheet such as the printing plate 55. 100391 In one embodiment, a retention device $\mathbf{50}_L$ is attached proximate to the leading edge of a printing plate 55 along the axial length of plate cylinder 60, and a retention device $\mathbf{50}_T$ is attached proximate to the trailing edge of the printing plate 55 along the axial length of plate cylinder 60 as shown. As discussed below, the clamping system can accommodate printing plates 55 of different dimensions as shown comparatively in FIGS. 1 and 3. An application/removal assembly 70 is located adjacent to cylinder 60 and includes a lift rake 75 having a series of spaced-apart projections 80. An imaging array 85 is located adjacent to the plate cylinder 60 for imaging printing plate 55.

Figure 4:
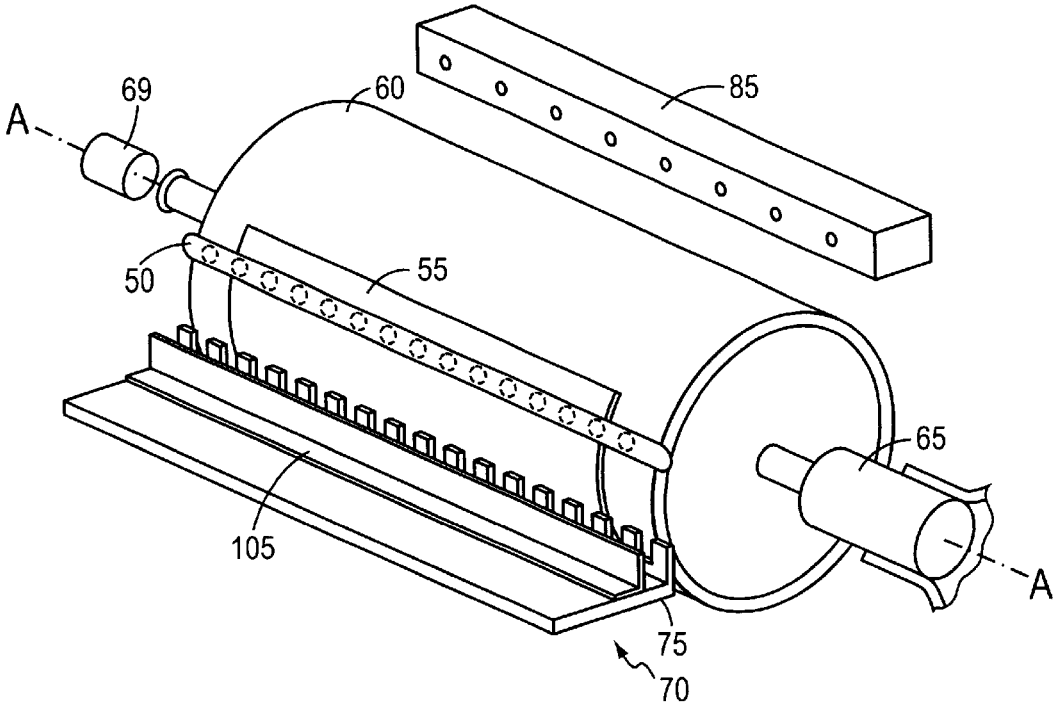
FIG. 4 is a schematic isometric view of the application/removal assembly engaging a plate cylinder in accordance with the invention.
Figure 5:
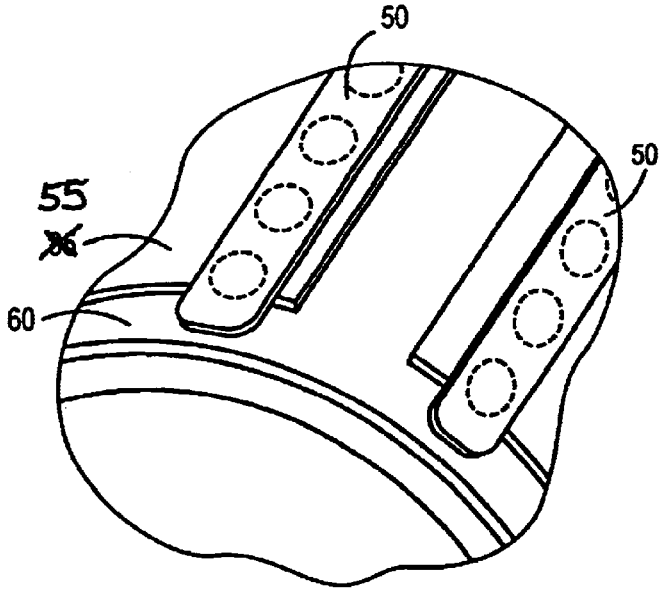
FIG. 5 is a detailed isometric view of a printing plate retained against a plate cylinder by leading and trailing retention devices according to one embodiment of the invention.

As shown in FIG. 4 and described in detail below, the application/removal assembly 70 is advanced in a radial direction until proximate to the plate cylinder 60 for depositing retention devices 50 onto plate cylinder 60 (in order to retain printing plate 55 thereto). Retention devices 50 may releasably secure plate 55 anywhere along the circumferential surface of cylinder 60, but are preferentially placed proximate to a leading edge and a trailing edge of printing plate 55 as shown in FIG. 5. Because placement of the retention devices 50 may occur anywhere along the circumferential surface of cylinder 60, printing plates 55 of different lengths may be easily accommodated with the retention system according to the invention.

Figure 6:
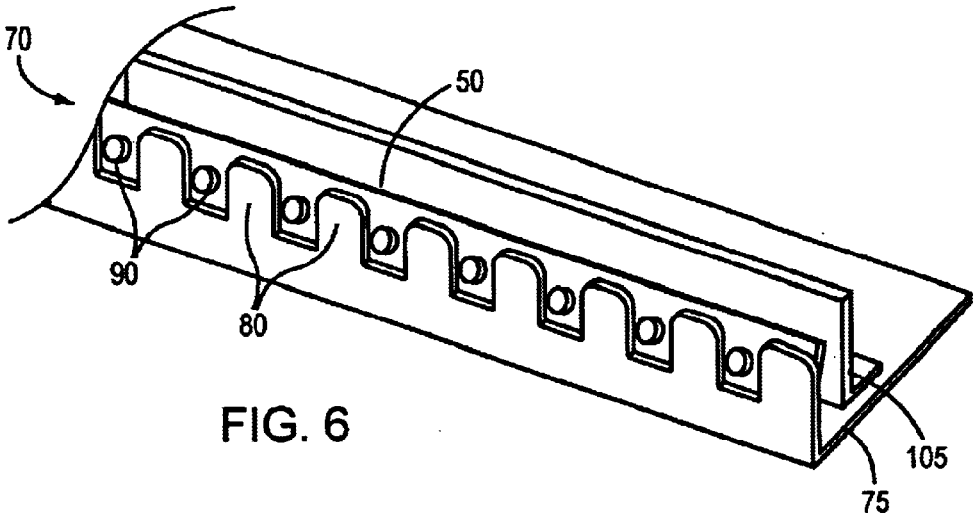
FIG. 6 is a detailed isometric view of the application/removal assembly holding a retention device.
Figure 7:
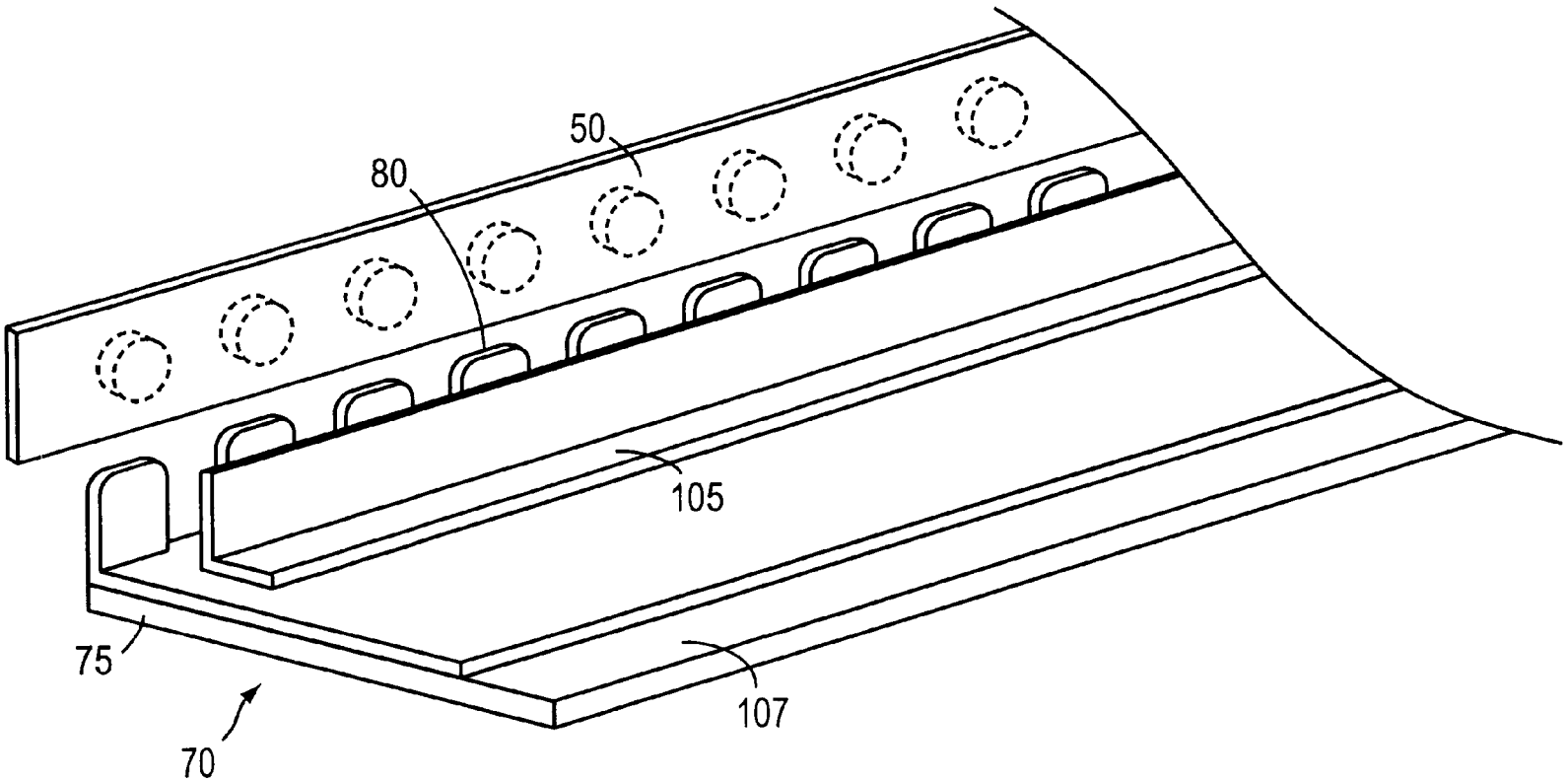
FIG. 7 is a detailed isometric view of a portion of the application/removal assembly and a retention device.
Figure 8:
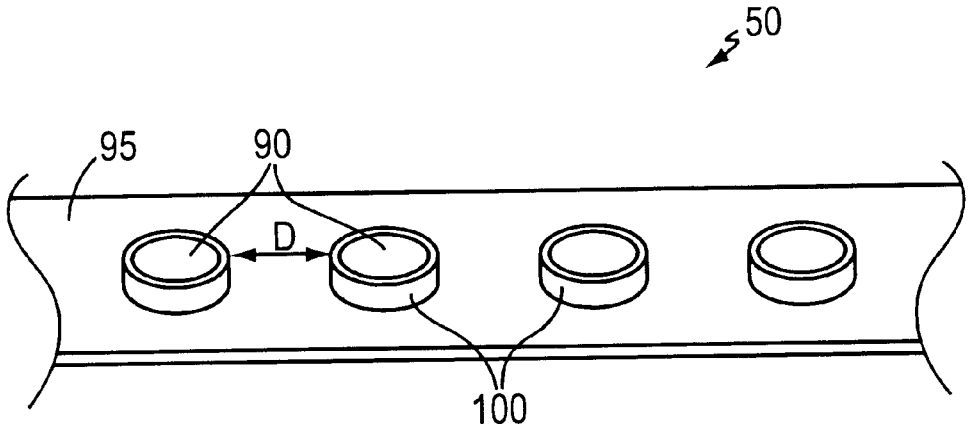
FIG. 8 is a detailed schematic view of a portion of the retention device in accordance with the invention.

As best seen in FIGS. 6–8, the retention device 50 comprises a plurality of discrete magnetic elements 90 attached to an elongated retention base 95 by means of retainer rings 100. In one embodiment, the magnetic elements 90 are equally spaced along retention base 95 and an interstitial distance D separates adjacent magnetic elements 90 (FIG. 8). The magnetic elements 90 may be of any shape and be arranged in any configuration along base 95 that permits magnetic adhesion of retention device 50 to plate cylinder 60. The elongated retention base 95 and retainer rings 100 may be constructed from cold-rolled steel or other suitable material. In one embodiment, base 95 has a length approximately equal to the longitudinal length of plate cylinder 60. For reasons that will be made apparent, base 95 may be dimensioned to permit bending and flexure of the retention device 50 as it is removed from plate cylinder 60 by the application/removal assembly 70.

With continued reference to FIGS. 6–8, the spacing D between magnetic elements 90 is sufficient to allow the projections 80 of the lift rake 75 to slip between distance D separating the magnetic elements 90. To allow closer engagement of the lift rake 75 with retention device 50 when the application/removal assembly 70 is advanced to the plate cylinder 60, the projections 80 may be contoured with an arc substantially matching the curvature of the cylinder 60. In general, to deposit the retention devices 50, the application/removal assembly 70 is radially advanced toward cylinder 60 such that magnetic elements 90 located between projections 80 magnetically bind preferentially to the surface of cylinder 60. The means for advancing the application/removal assembly 70 toward cylinder 60 are described in detail in the preferred embodiments below. For example, the application/removal assembly 70 may employ a pneumatic, hydraulic, or other suitable means for actuation. Cylinder 60 may be constructed from cold-rolled steel and plated with nickel so as to make the surface of cylinder 60 magnetically susceptible, and as a result, the magnetic elements 90 are drawn thereto. Rotation of cylinder 60 in the direction shown (FIG. 1) slides retention device 50 out of application/removal assembly 70, leaving it magnetically affixed to cylinder 60 (and thereby affixing an intervening printing plate 55 to cylinder 60).

As best seen in FIG. 7, device holding bracket 105 is mounted to lift rake 75, extending upwardly and defining a distance therebetween. The lift rake 75 is itself mounted to a lift plate floor 107. In one embodiment, holding bracket 105 extends upward and is substantially normal to the lift plate floor 107. In other embodiments, holder bracket 105 is angled away from the projections 80 of lift rake 75. Holding bracket 105 is magnetically susceptible to attract and releasably hold the retention device 50 until it is reapplied to the plate cylinder 60 (or removed from the application/removal assembly 70). In order to facilitate application of retention device 50 to cylinder 60, magnetic elements 90 (FIG. 8) should be more strongly attracted to cylinder 60 than to holding bracket 105. This may be accomplished, for example, through use of a nonmagnetic retention base 95 (which is interposed between the magnetic elements 90 and the holding bracket 105, thereby reducing the magnetic attractive force) or utilizing a holding bracket 105 that is less magnetically susceptible than cylinder 60. The small distance between the projections 80 and the holding bracket 105 permits the magnetic elements 90 of the retention device 50 to protrude from (or at least remain located between) the projections 80.

Depending upon the method of application and removal of the retention device 50, the application/removal assembly 70 may be realized in various forms, three of which will now be described. In a first embodiment of the application/removal assembly 70, retention device 50 is removed from plate cylinder 60 by detaching a first end of retention device 50 and progressively removing the remaining portion of the retention device 50 in a longitudinal direction until the second end of retention device 50 is detached from the plate cylinder 60. In this manner, the retention device 50 is "peeled" away in a longitudinal direction from the surface of the plate cylinder 60, and the requisite force to remove the retention device 50 is reduced relative to a concerted removal of the entire device. In a second embodiment of the application/removal assembly 70, retention device 50 is removed from plate cylinder 60 by first detaching the upper portion of the retention device at once along its entire longitudinal length and progressively removing the remaining portion of retention device 50 in a vertical or circumferential direction until the lower portion of retention device 50 is detached from the plate cylinder 60. Accordingly, the retention device is now peeled away in a circumferential direction from the surface of the plate cylinder 60, similarly reducing the requisite removal force. In a third embodiment of the application/removal assembly 70, all portions of retention device 50 in contact with plate cylinder 60 are directly removed from the plate cylinder 60 at substantially the same time.

1. Longitudinal Progressive Removal of the Retention Device

Figure 9:
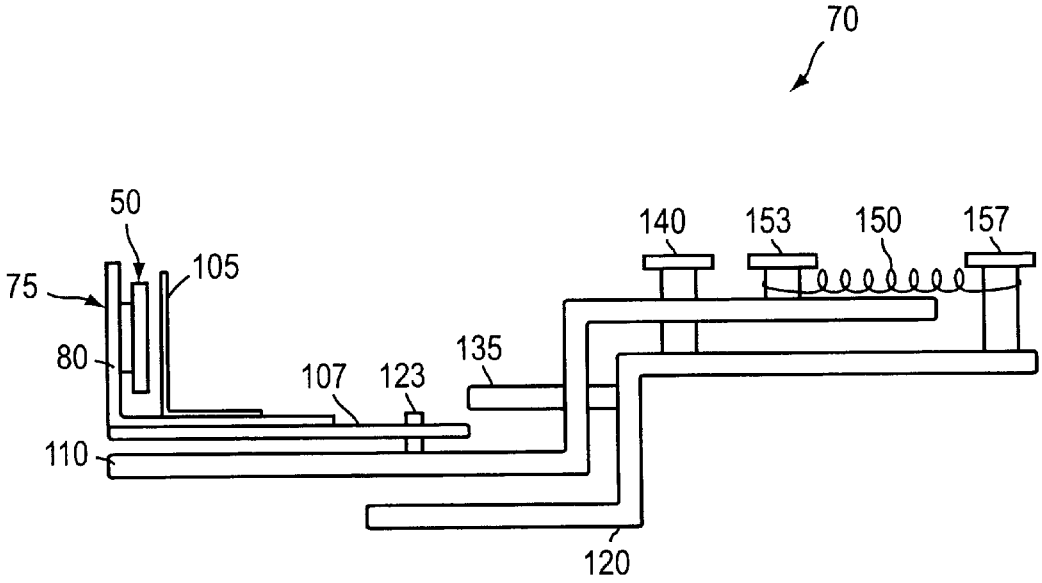
FIG. 9 is a side elevation of a portion of the application/removal assembly holding a retention device.
Figure 10:
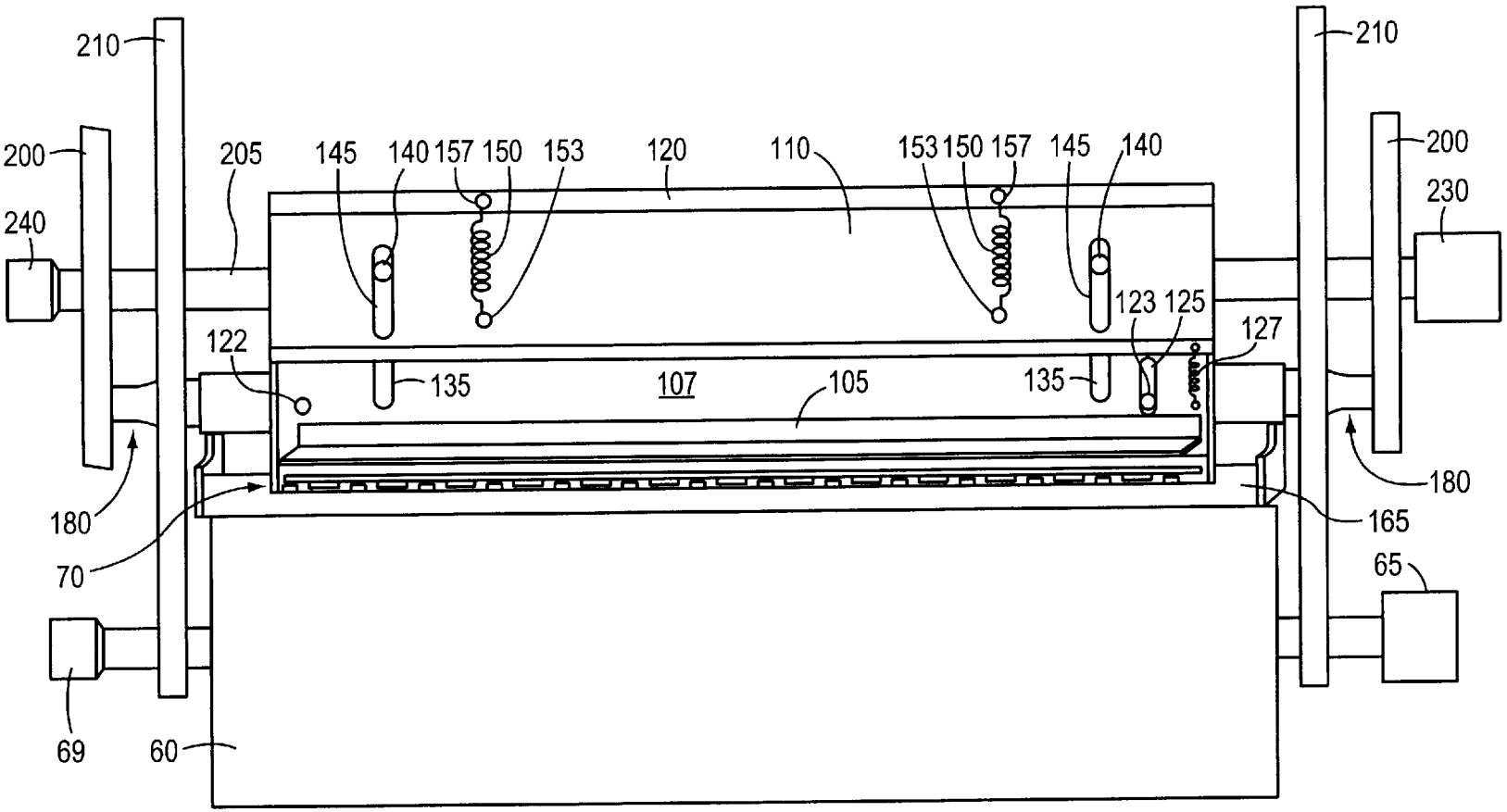
FIG. 10 is an elevation of an embodiment of the magnetic-plate retention system.

Referring to FIGS. 9 and 10, in a first embodiment, the application/removal assembly 70 broadly considered includes the lift rake 75, the lift plate floor 107, a slide plate 110, and a slide base 120. As described below, slide plate 110 is configured and adapted for translational movement relative to base plate 120. The lift rake 75 is rigidly attached to the lift plate floor 107 such that projections 80 are substantially normal to the lift plate floor 107. A first end of the lift plate floor 107 is rotatably attached to a first end of slide plate 110 at a lift plate floor pivot 122 and a second end of the lift plate floor 107 slideably engages a second end of slide plate 110 at a slide plate guide pin 123 attached to slide plate 110 and disposed through a lift plate floor slot 125. A lift plate return spring 127 biases the second end of the lift plate floor 107 toward the rear of the slide plate 110 at the second end thereof. Slide plate 110 supporting the lift plate floor 107, lift rake 75, and holding bracket 105, translates relative to the slide base 120 guided by two pairs of pins. A pair of horizontal guide pins 135 mounted to first and second ends of the slide base 120 project through apertures in the slide plate 110. A pair of vertical guide pins 140 affixed to first and second ends of the slide base 120 extend through corresponding lift plate floor slots 145.

Figure 11:
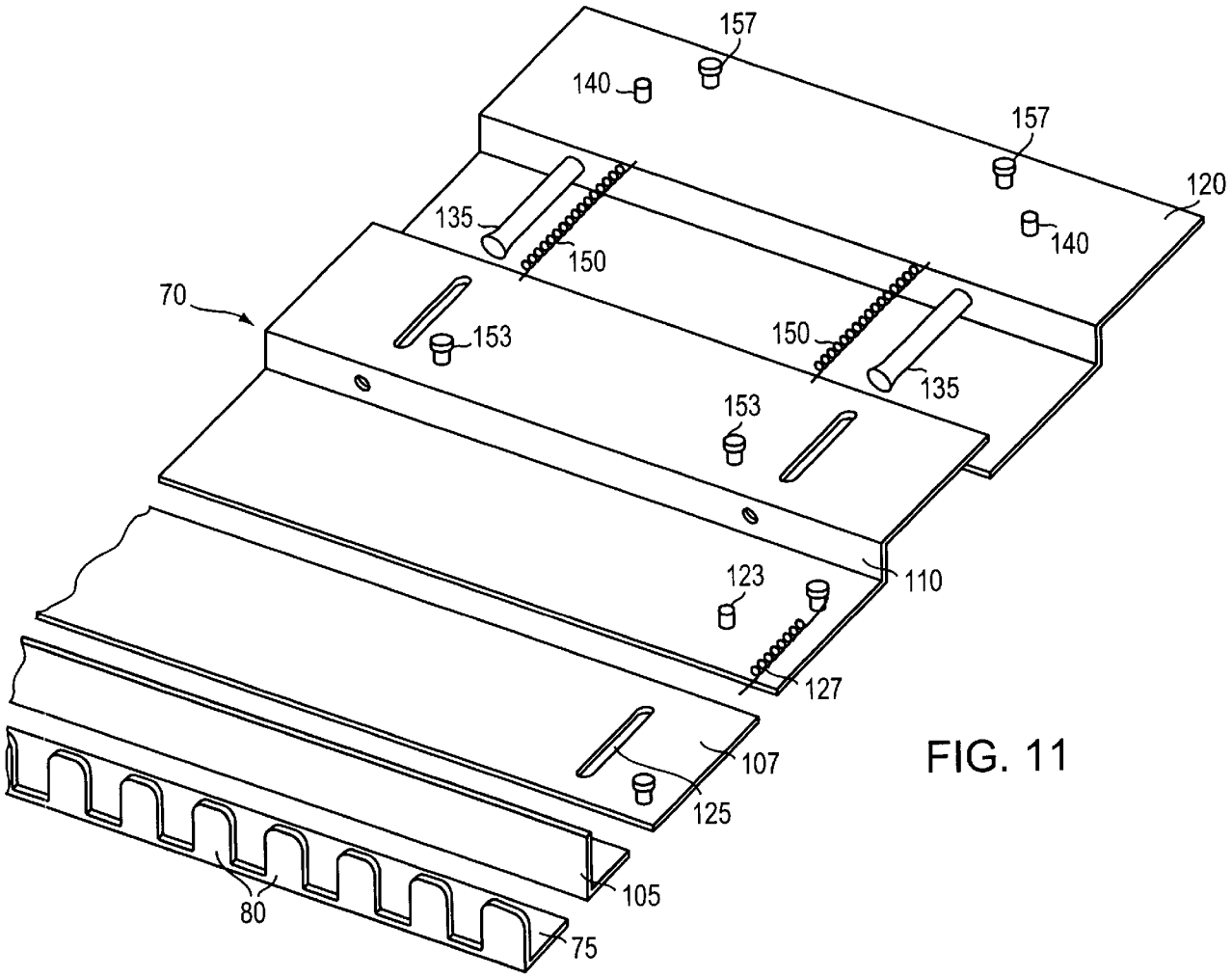
FIG. 11 is an exploded view of the embodiment depicted in FIG. 10 showing the major components of the application/removal assembly.
Figure 12:
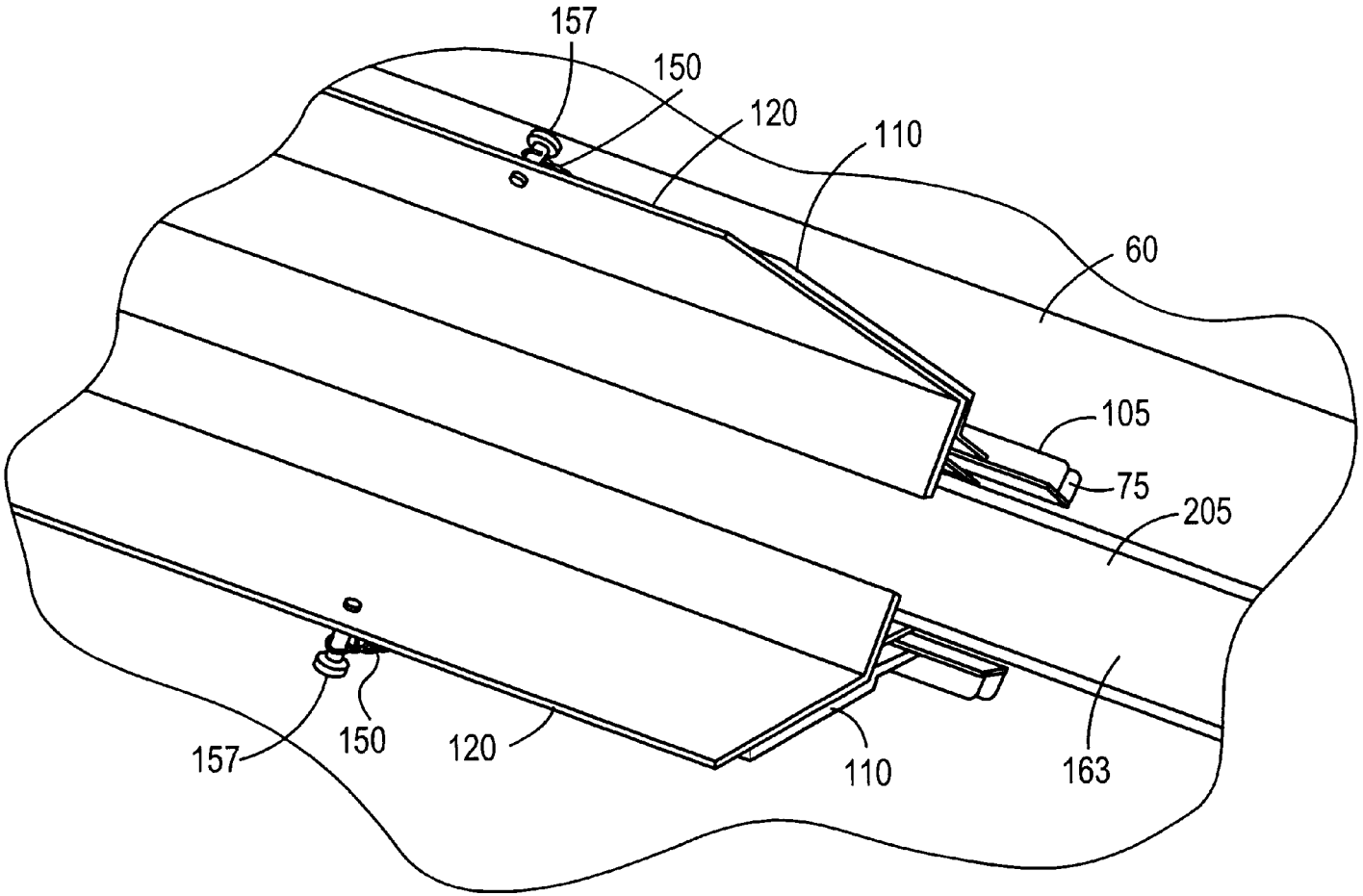
FIG. 12 is a detailed side elevation of the embodiment depicted in FIG. 10 showing the application/removal assembly proximate to the plate cylinder.
Figure 13:
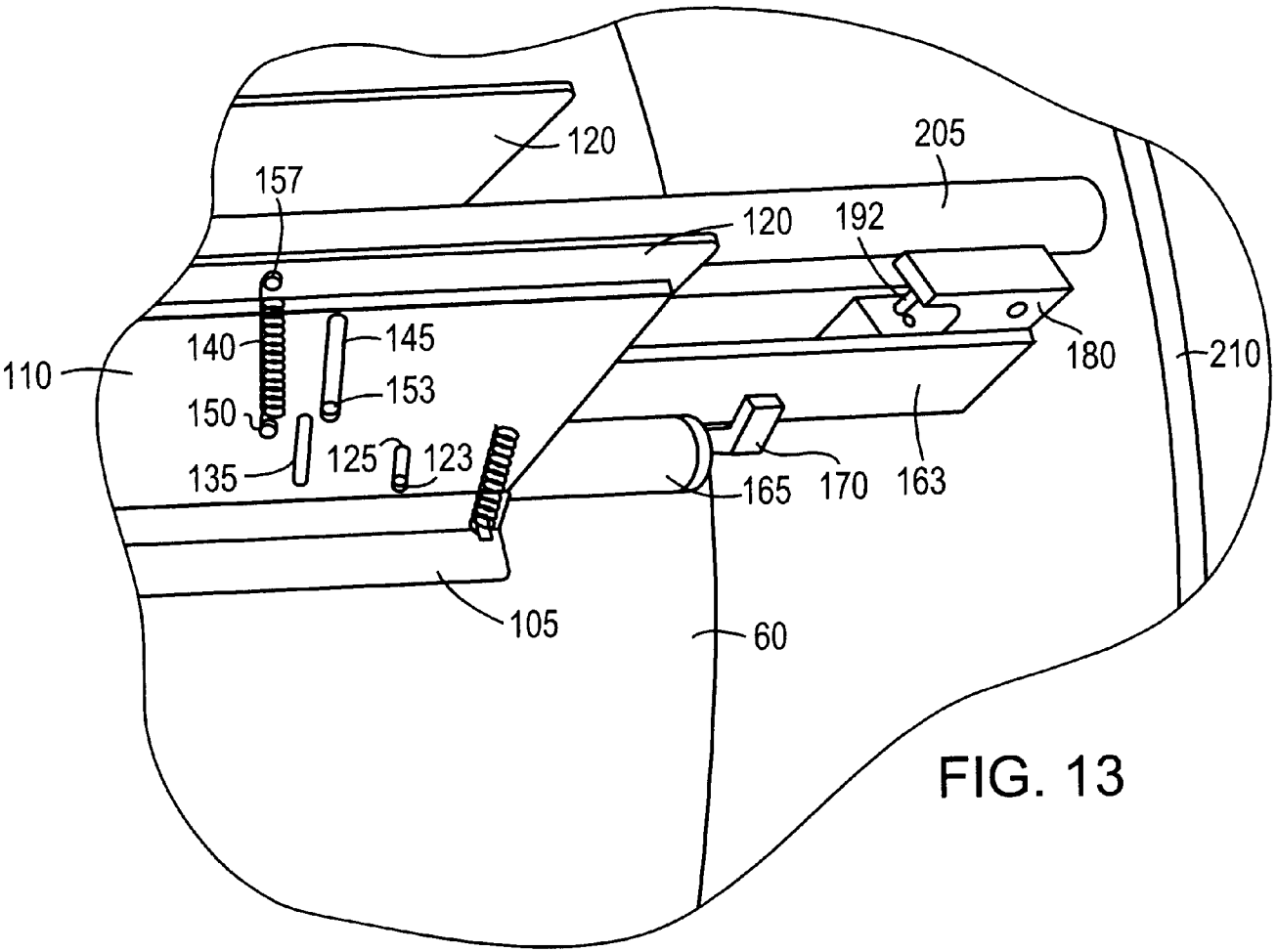
FIG. 13 is a detailed bottom elevation of the embodiment depicted in FIG. 10 showing the application/removal assembly proximate to the plate cylinder.

Referring now to FIGS. 11–13, along with FIGS. 9 and 10, slide plate 110 and slide base 120 are biased together with, for example, return springs 150, attached to the slide plate 110 at slide plate posts 153 and to the slide base 120 at slide base posts 157. The slide base 120 is supported by attachment to a U–shaped channel 163. An identical lift rake 75, slide plate 110, and slide base 120 may be attached to an opposing side of the channel 163 as shown in FIG. 12. In this embodiment, each lift rake 75, arranged on a single application/removal assembly 70, holds and dispenses a separate retention device 50 for positioning onto the leading and trailing edges of the printing plate 55.

Figure 19A:
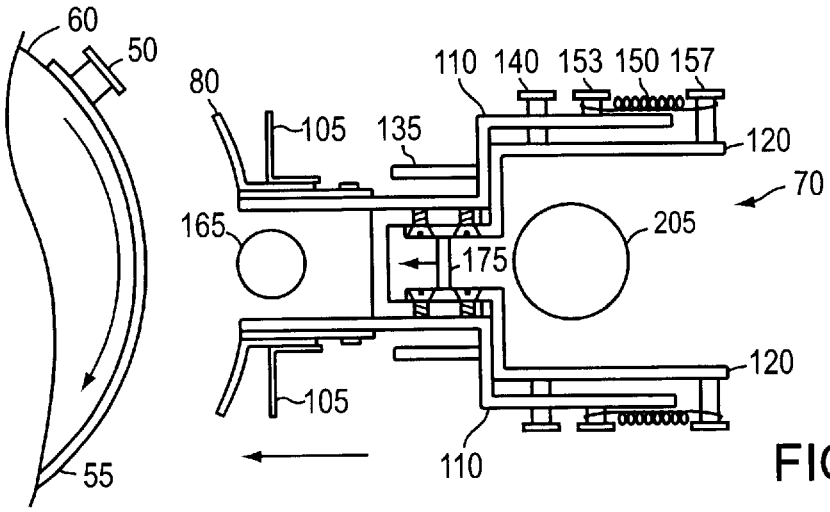
FIGS. 19A–19C are side elevations depicting the application/removal assembly removing a retention device from the plate cylinder.
Figure 19B:
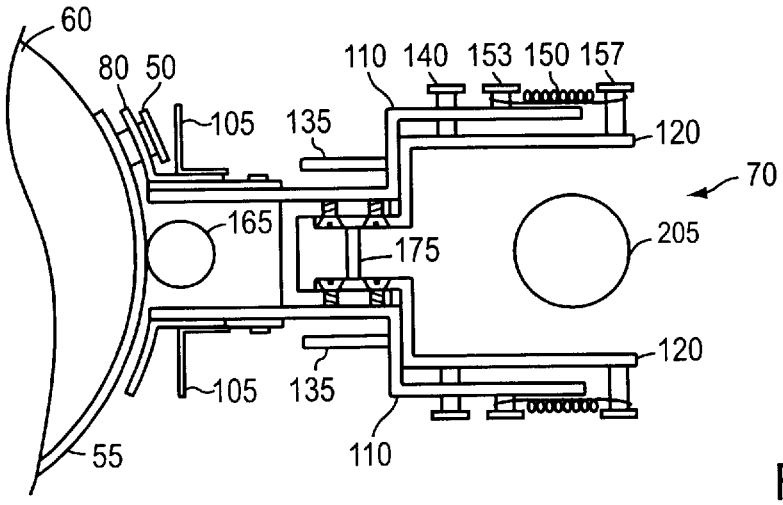
Figure 19C:
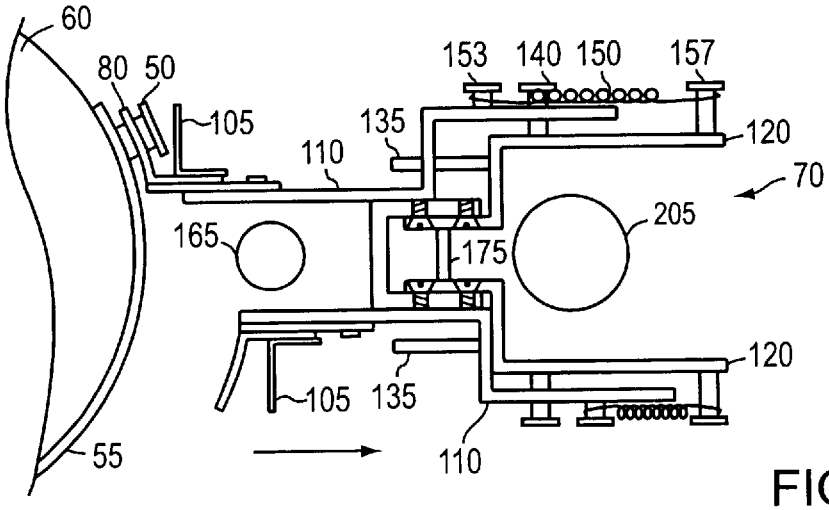

An elongated plate roller 165 (see FIGS. 10, 13, and 14) may be rotatably mounted to roller supports 170 (which are themselves attached to first and second ends of channel 163) for maintaining the printing plate 55 proximate to the surface of plate cylinder 60 when the application/removal assembly 70 is moved proximate thereto. The roller 165 may be coated with a substantially resilient or compliant material, for example foam or rubber, to avoid damaging plate cylinder 60 or printing plate 55 when in rolling contact therewith. A spacer element 175 (FIGS. 19A–19C) may be disposed within the inside of channel 163 to secure slide bases 120 thereto and to provide additional structural support to the application/removal assembly 70.

Figure 14:
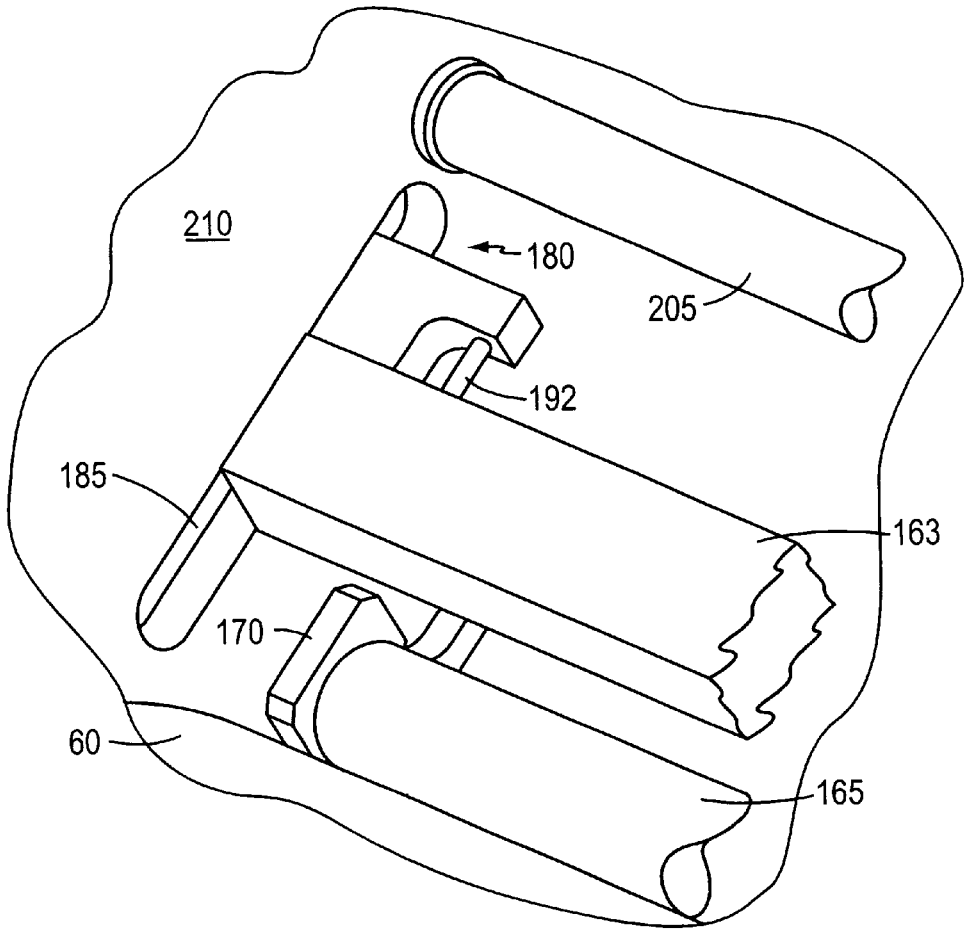
FIG. 14 is a detailed isometric view of the embodiment depicted in FIG. 10 showing a bearing assembly channel, and inner side of the frame.
Figure 15:
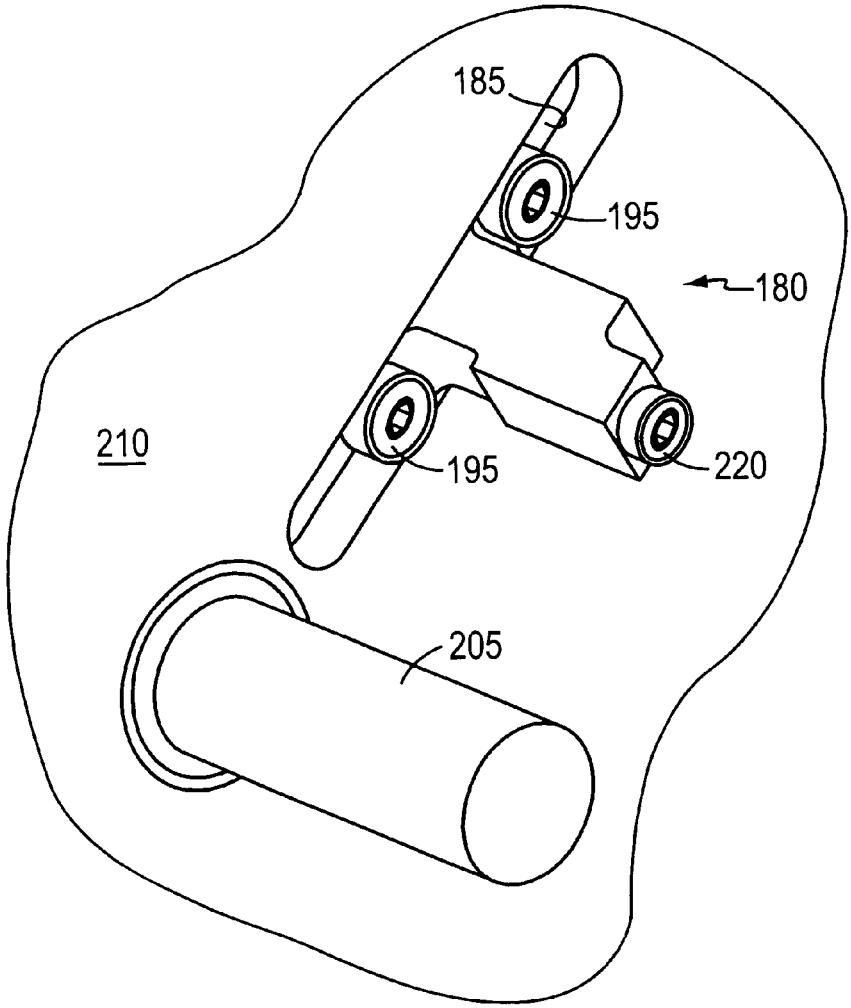
FIG. 15 is a detailed isometric view of the embodiment depicted in FIG. 10 showing a bearing assembly and an outer side of the frame.

With reference to FIGS. 14 and 15, bearing assemblies 180 are attached to first and second ends of channel 163 and slideably coupled in frame channels 185. Stanchions 192 (FIG. 14) may be provided to rigidly couple bearing assemblies 180 to the first and second ends of channel 163. The bearing assemblies 180 may include slot bearings 195 to aid translational movement within frame channels 185.

Figure 16B:
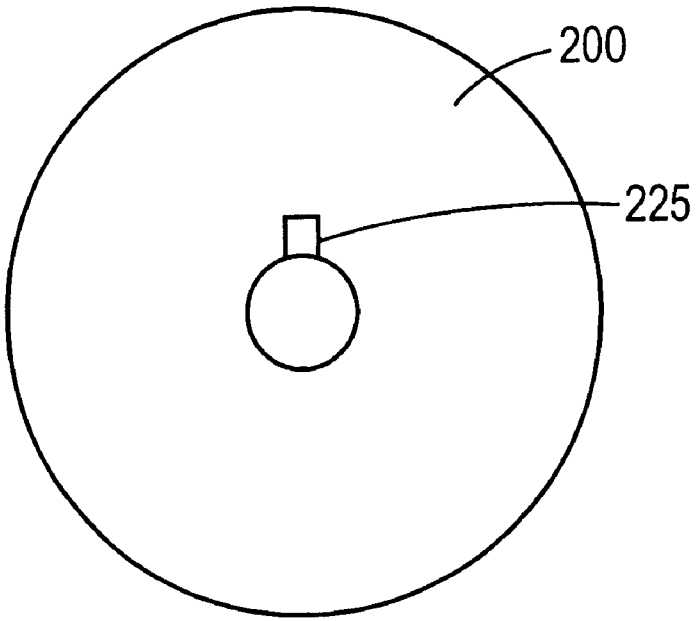
FIG. 16B is a detailed view of the embodiment depicted in FIG. 10 showing the reverse side of the slide rotor.
Figure 16A:
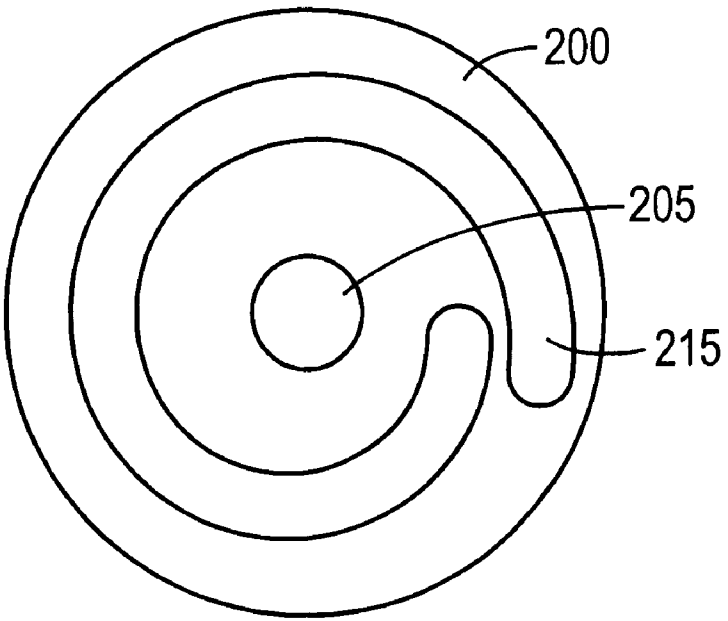
FIG. 16A is a detailed view of the embodiment depicted in FIG. 10 showing the obverse side of the slide rotors.

As shown in FIG. 10, a pair of rotors 200 are attached to first and second ends of a shaft 205 extending through and supported by a frame 210. Now referring to FIGS. 16A–16B, spiral cam-ways 215 are disposed on the inner surfaces of rotors 200. Cam bearings 220 are attached to outer end of bearing assemblies 180 are shaped and arranged to movably engage the cam-ways 215 disposed in the rotors 200. Rotors 200 are retained to the ends of shaft 205 with set screws 225. A shaft motor 230 is coupled to a first end of shaft 205 and a shaft encoder 240 is coupled to a second end of shaft 205. The shaft 205 may be rotated by shaft motor 230 under the control of the programmable controller 67 (FIG. 1). The controller 67 may receive a signal from the shaft encoder 240 which enables the controller 67 to monitor the angular position of shaft 205.

Operation of this embodiment of the application/removal assembly 70 may be understood with reference to FIGS. 17A–17C, 18A–18D, and 19A–19C. A signal from controller 67 rotates cylinder motor 65 until cylinder 60 is positioned so that the portion of plate 55 that requires retention (e.g., the leading or the trailing edge of the plate 55) is opposed to the application/removal assembly 70. The application/removal assembly 70 is then advanced toward the plate cylinder 60 as follows. A signal from controller 67 instructs shaft motor 230 to rotate shaft 205 and rotors 200, thereby advancing cam bearings 220 through cam–ways 215. As the rotors 200 rotate, cam bearings 220 disposed within cam–ways 215 advance in a radially inward direction, causing the bearing assemblies 180 to move within frame channels 185 and thereby moving application/removal assembly 70 toward plate cylinder 60. The shaft encoder 240 determines the angular position of shaft 205 and signals the controller 67 to stop rotation of shaft motor 230 and thus movement of the application/removal assembly 70 at a predetermined position, for example, when elongated plate roller 165 contacts plate 55 (see FIGS. 19A and 19B) and positions it firmly against cylinder 60. At this position, the projections 80 are in close proximity to the plate cylinder 60. Because of the short distance between the projections 80 of the lift rake 75 and the holding bracket 105, and preferential attraction of the magnets 90 for cylinder 60, the magnets 90 are preferentially drawn to the surface of cylinder 60 from the less magnetically susceptible bracket 105. The cylinder 60 is then rotated to clear the engagement of the projections 80 from the interstitial spaces between the magnetic elements 90 and the application/removal assembly 70 is backed away from the cylinder 60. More particularly, a signal from controller 67 to shaft motor 230 reverses the rotation of shaft 205 and rotors 200, thereby advancing cam bearings 220 through cam–ways 215 opposite the direction for advancement of the application/removal assembly 70. Again, the shaft encoder 240 determines the angular position of shaft 205 and signals the controller to stop rotation of shaft motor 230, thus stopping movement of the application/removal assembly 70 at a predetermined retracted position.

Once the application/removal assembly 70 is properly retracted and one or more retention devices 50 are applied to printing plate 55, the plate cylinder 60 is rotated by cylinder motor 65 under the control of controller 67, for imaging of the printing plate 55 by the imaging array 85. After imaging of the printing plate 55 the retention devices 50 are removed from the plate cylinder 60. Multiple retention devices 50 may be removed and releasably held utilizing a single application/removal assembly 70 or in other embodiments, multiple application removal assemblies 70 may be employed, each removing and retaining a single retention device 50. Removal of a retention device begins with radial advancement of the application/removal assembly 70 toward cylinder 60, as described above.

Figure 17A:
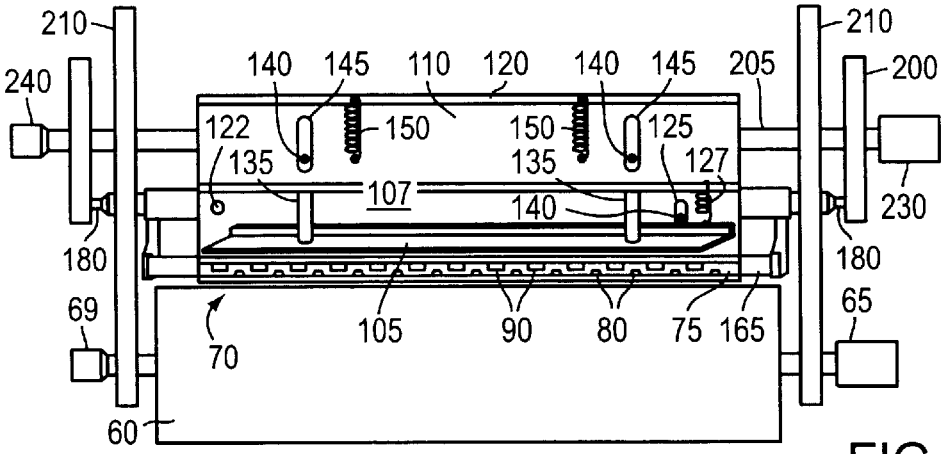
FIGS. 17A–17C are elevations depicting the application/removal assembly removing a retention device from the plate cylinder.
Figure 17B:
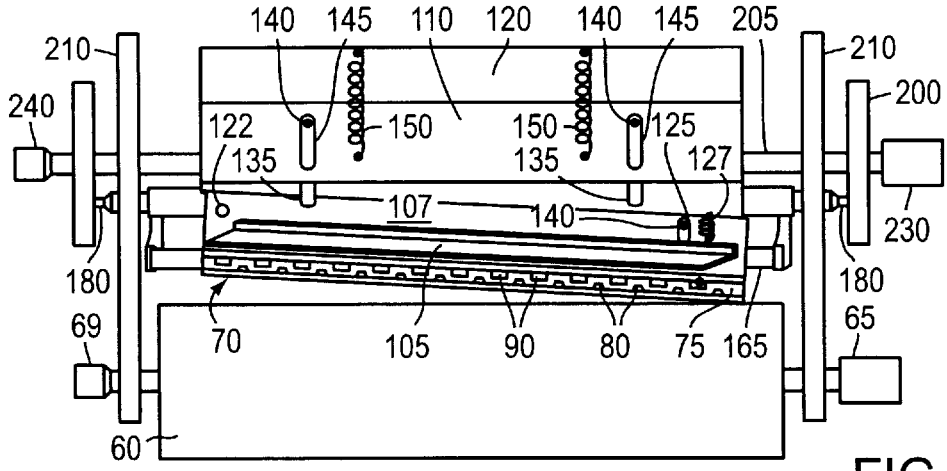
Figure 17C:
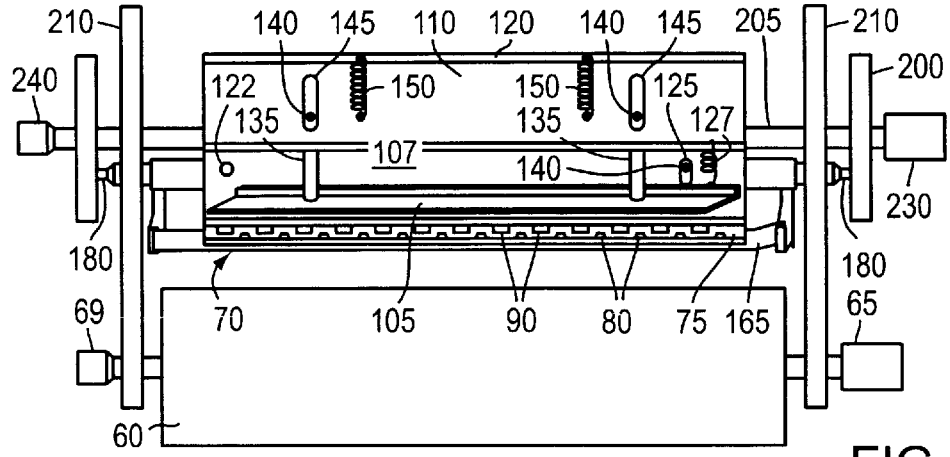
Figure 18A:
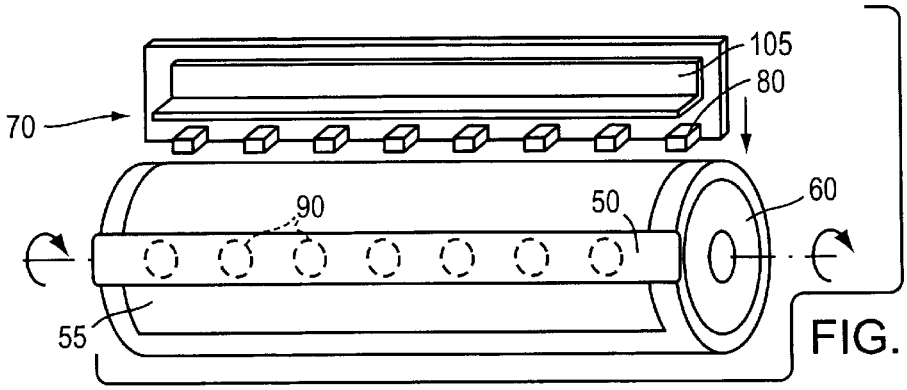
FIGS. 18A–18D are front elevations depicting the application/removal assembly removing a retention device from the plate cylinder.
Figure 18B:
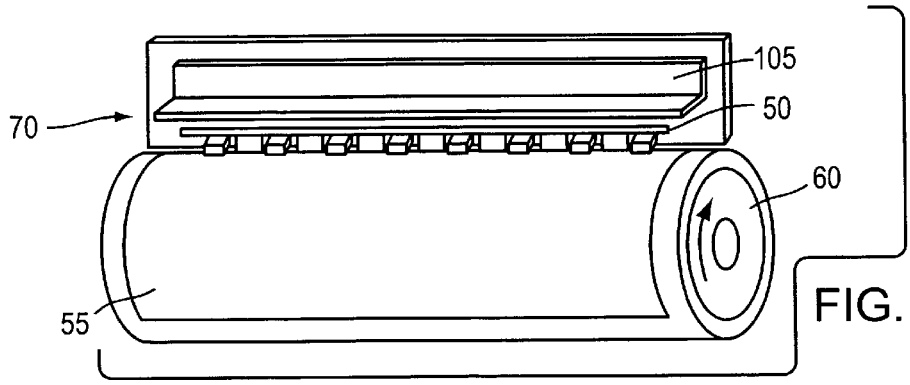
Figure 18C:
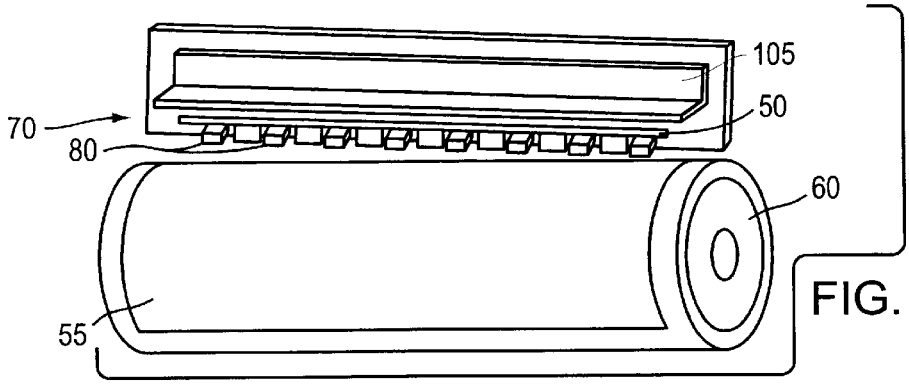
Figure 18D:
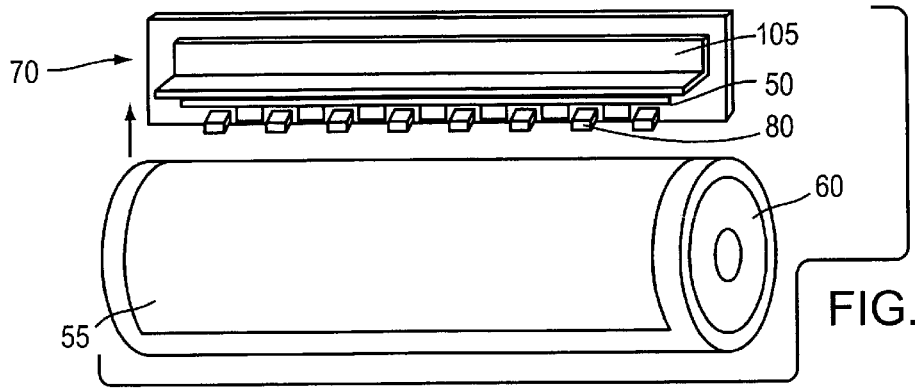

Now that projections 80 of lift rake 75 are again in close proximity to the plate cylinder 60, cylinder 60 is rotated to engage the projections 80 between the magnetic elements 90 of retention device 50 as shown in FIG. 18B. Next, the application/removal assembly 70 is radially backed away from the cylinder 60, but in a side-to-side fashion. As shown in FIG. 17B, a first side of the application/removal assembly 70 is detached first, such that magnetic elements 90 are separated from cylinder 60 sequentially rather than simultaneously, i.e., the retention device 50 is "peeled" away from the cylinder 60 along a direction parallel to the axis of rotation of the cylinder 60. The second end of the applicator/removal assembly 70 then swings away from the cylinder 60 as shown in FIG. 18D. The retention device 50 is magnetically drawn to the holding bracket 105 and is thereby retained within the application/removal assembly 70. A signal from controller 67 instructs shaft motor 230 to rotate shaft 205 clockwise for removing the retention device 50 as described above. The rotation of rotors 200 advance cam bearings 220 along the cam-ways 215 in a radially outward direction, causing the bearing assemblies 180 to move within frame channels 185, thereby retracting the application/removal assembly from plate cylinder 60.

Mechanical operations underlying the progressive swinging movement of the application/removal assembly 70 are best understood with reference to FIGS. 10, 17A–17C, and 18A–18D. As shown in FIG. 17B, when the application/removal assembly 70 retracts from plate cylinder 60, the first end (i.e., the left end in the figures) of the lift rake 75 attached to the lift plate floor pivot 122 detaches a first end of the retention device 50 from the plate cylinder 60. As the second end (i.e., the right end in the figures) of retention device 50 remains magnetically attached to cylinder 60, the second end of the lift plate floor 107 slides along the slide plate 110 guided by travel of the slide plate guide pin 123 though the slide plate slot 125. This occurs against the bias of the lift plate spring 127 thereby permitting the retention device 50 to be progressively removed or "peeled" from the surface of cylinder 60. When the slide plate guide pin 123 reaches the end of the slide plate slot 125, the second end of retention device 50 finally detaches from cylinder 60. With retention device 50 fully detached, the lift plate return spring 127 now returns the lift plate floor 107 to its original position.

Slide plate 110 may also move relative to slide base 120 against the spring bias provided by return springs 150 as the application/removal assembly 70 retracts from plate cylinder 60. The arrangement provides additional latitude as the retention device 50 is removed from the plate cylinder 60.

2. Vertical Progressive Removal of the Retention Device

Figure 20:
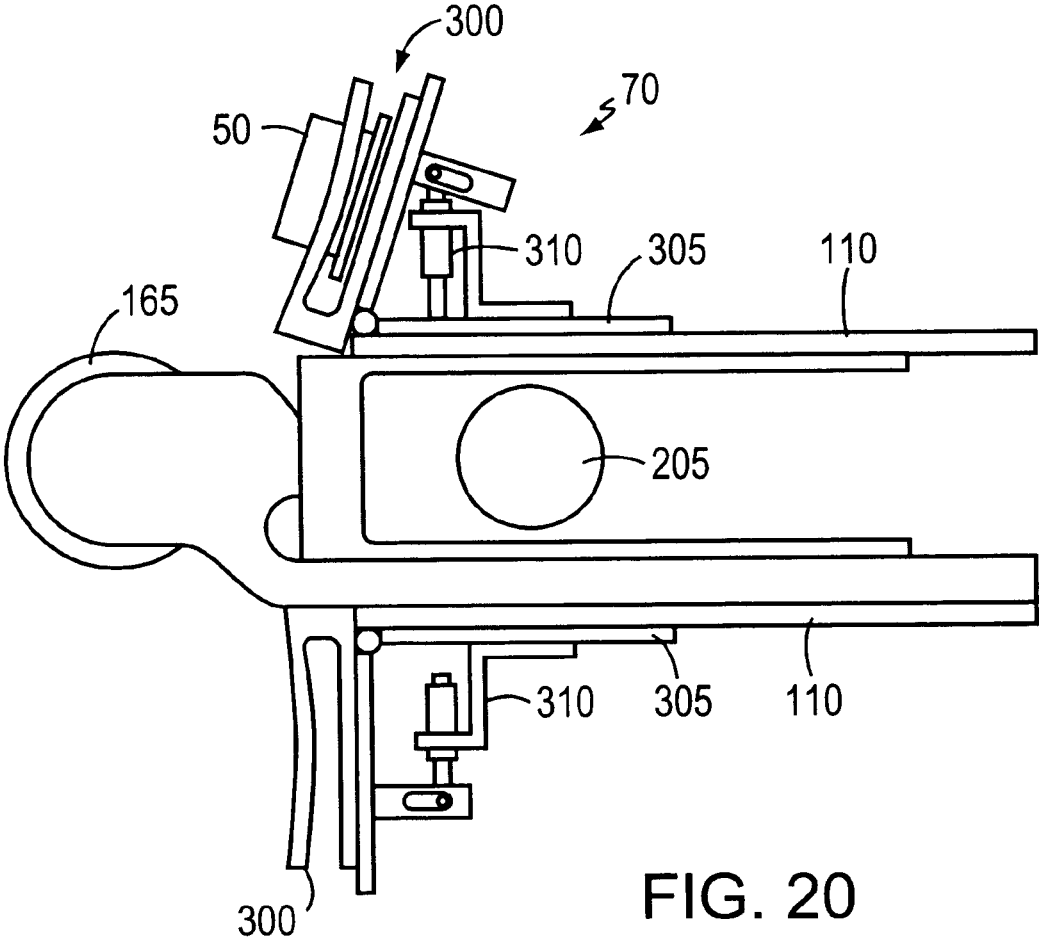
FIG. 20 is a side elevation of an embodiment of the application/removal assembly proximate to a plate cylinder.

With reference to FIG. 20, in a second embodiment, the application/removal assembly 70 now comprises a modified lift rake 300 affixed to slide plate 110 by a hinge 305. A solenoid 310 connects the moveable surfaces of hinge 305 and is controlled by the programmable controller 67. The remaining structure of the assembly 70 in this second embodiment differs generally from the first embodiment in that it lacks the lift plate floor 107, the slide base 120 and the attendant components thereto.

Figure 21B:
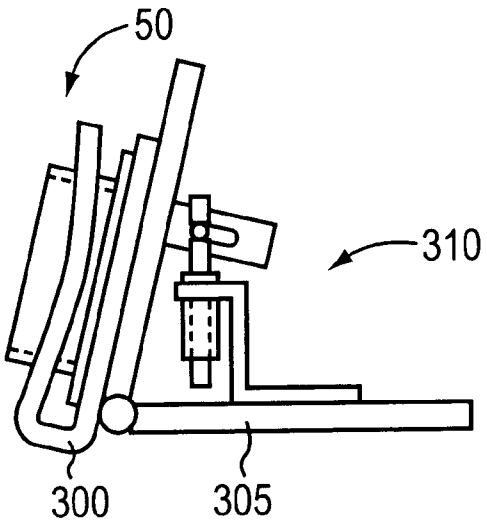
FIG. 21B is a detailed side elevation of the embodiment depicted in FIG. 20 showing the application/removal assembly holding a retention device in a retracted position.
Figure 21A:
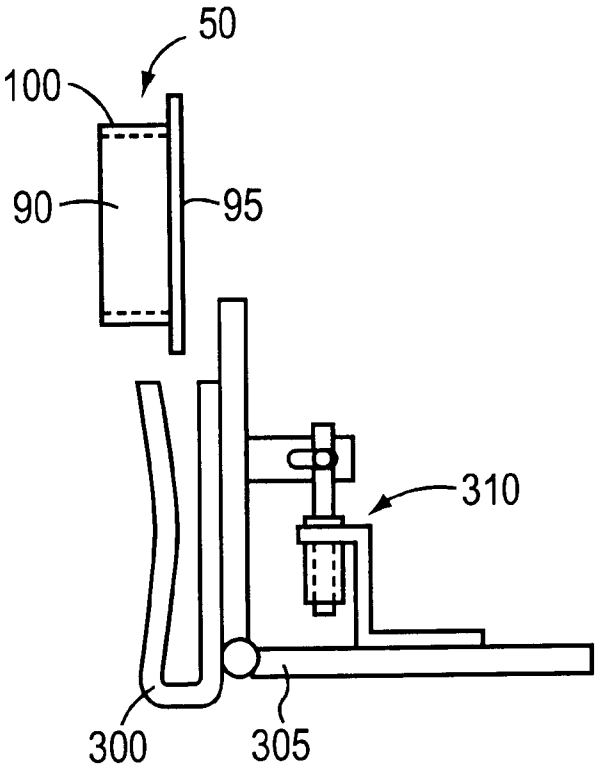
FIG. 21A is a detailed side elevation of the embodiment depicted in FIG. 20 showing the application/removal assembly in an extended position.

Similarly, the operation of the second embodiment differs from the first embodiment as described below. As seen in FIGS. 21A, 21B, a signal from controller 67 energizes solenoid 310, which rotates the portion of hinge 305 affixed to the modified lift rake 300 away from cylinder 60. As hinge 305 rotates, an upper portion of the retention device 50 detaches from cylinder 60 followed by remaining middle and lower portions of retention device 50. When the portion of hinge 305 affixed to the modified lift rake 300 is at about a 45° angle to the slide plate 110 as illustrated in FIG. 21B, the application/removal assembly 70 retracts away from cylinder 60 as described in the operation of the first embodiment.

3. Direct Removal of the Retention Device

Figure 22:
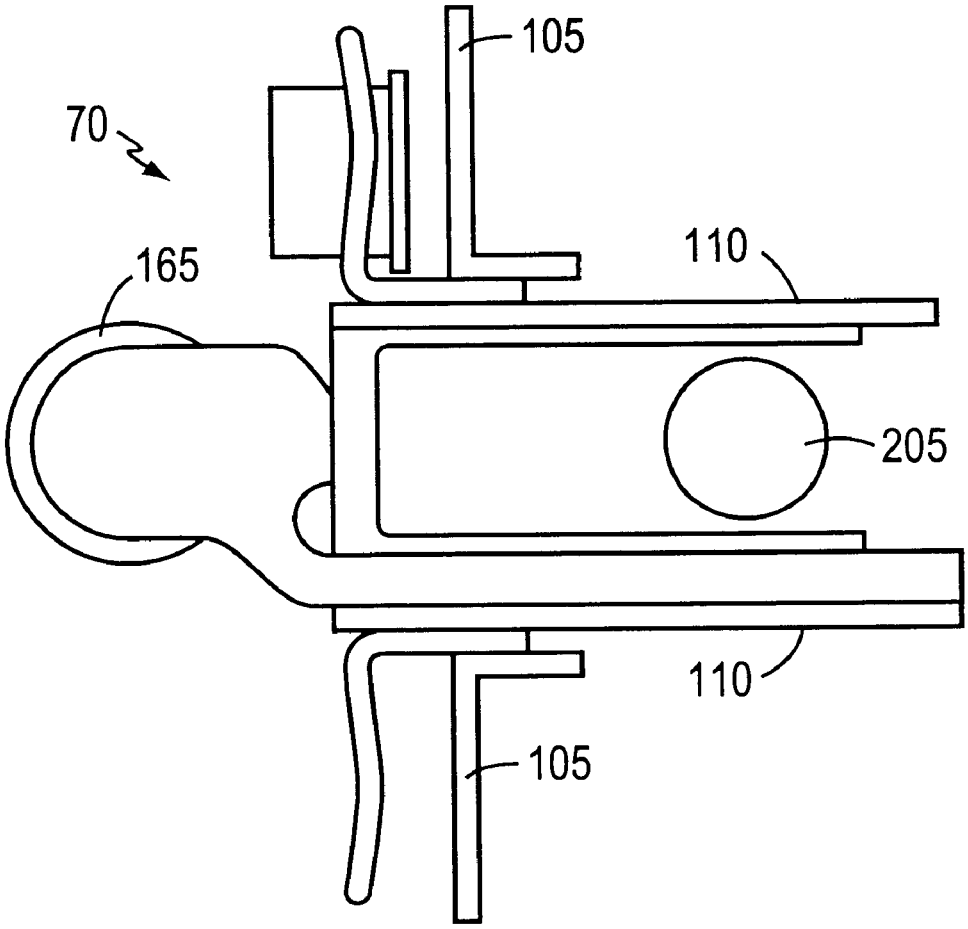
FIG. 22 is a side elevation of a preferred embodiment of the application/removal assembly proximate to a plate cylinder.

Refer now to FIG. 22, which shows the application/removal assembly 70 in a third embodiment. The remaining structure of the application/removal assembly 70 in this third embodiment differs generally from the first embodiment in that it lacks a lift plate floor 107 the slide base 120 and the attendant components thereto.

The operation of the third embodiment of the application/removal assembly 70 differs from the first embodiment as described below. Generally, the application/removal assembly 70 is radially advanced toward the plate cylinder 60 until roller 165 contacts plate 55 and positions it firmly against cylinder 60. Cylinder 60 is rotated until the retention device 50 is engaged by application/removal assembly 70. As the application/removal assembly 70 is radially withdrawn from the cylinder 60, the retention device 50 is detached from plate 55, thereby releasing it from the cylinder 60. More specifically, all portions of retention device 50 in contact with the printing plate 55 (i.e., magnetic elements 90) detach from the printing plate 55 substantially simultaneously as the application/removal assembly 70 is withdrawn from cylinder 60. As described above, a signal from controller 67 to shaft motor 230 reverses the rotation of shaft 205 and rotors 200, thereby advancing cam bearings 220 through cam-ways 215 opposite the direction for advancement of the application/removal assembly 70. Again, the shaft encoder 240 determines the angular position of shaft 205 and signals the controller to stop rotation of shaft motor 230, thus stopping movement of the application/removal assembly 70 at a predetermined retracted position. Alternatively, manual operation of the application/removal assembly 70 is possible.

It will therefore be seen that we have developed a system for retaining and releasing a recording member such as a lithographic printing plate or donor/acceptor sheets to a cylinder for printing. The system as described herein does not require a modified plate cylinder and easily permits retention of recording members of varying dimension. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. Apparatus for securing a recording medium to a rotatable supporting means comprising at least a magnetically susceptible surface, the apparatus comprising:

a. a first elongated retention device for releasable attachment to the supporting means over the recording medium, the retention device comprising at least one magnetic element; and b. an application/removal assembly for holding and dispensing the retention device, the application/removal assembly being positionable with respect to the supporting means such that (i) when the application/removal device holds the retention device, positioning the application/removal assembly proximate to the supporting means causes the retention device to be magnetically attached to the supporting means and rotation of the supporting means in a first direction causes the retention device to disengage from the application/removal assembly, (ii) when the retention device is attached to the supporting means, rotation of the supporting means in a second direction causes the retention device to engage the application/removal assembly, and (iii) when the application/removal assembly is retracted, the retention device is removed from the supporting means.

2. The apparatus of claim 1 wherein (i) the retention device comprises a plurality of magnetic elements, and (ii) when the application/removal assembly is retracted, the retention device is removed such that the plurality of magnetic elements detach substantially simultaneously from the supporting means.

3. The apparatus of claim 1 wherein when the application/removal assembly is retracted, the retention device progressively detaches from the supporting means along a longitudinal direction parallel to the axis of rotation of the supporting means.

4. The apparatus of claim 1 wherein the application/removal assembly is rotatably retracted, causing the retention device to progressively detach from the supporting means along a direction normal to the axis of rotation of the supporting means.

5. The apparatus of claim 2 wherein the plurality of discrete magnetic elements of the retention device are separated by interstitial spaces and the application/removal assembly comprises a plurality of projections for engaging the interstitial spaces of the retention device.

6. The apparatus of claim 5 further comprising a second elongated retention device for releasable attachment to the supporting means.

7. The apparatus of claim 6 wherein the application/removal assembly holds and dispenses the first and second elongated retention devices.

8. The apparatus of claim 1 wherein the application/removal assembly further comprises a magnetically susceptible member for retaining the retention device, the retention device being attracted less strongly to the magnetically susceptible member than to the supporting means.

9. The apparatus of claim 8 further comprising actuation and control means for automatic operation of the rotatable supporting means.

10. The apparatus of claim 9 wherein the application/removal assembly further comprises actuation and control means for automatic operation.

11. The apparatus of claims 10 wherein the rotatable supporting means comprises a plate cylinder and the recording medium comprises a printing plate.

12. The apparatus of claims 10 wherein the recording medium comprises an acceptor sheet wrapped around the cylinder and a donor sheet wrapped around the acceptor sheet.

13. A method for securing a recording medium to a rotatable supporting means comprising at least a magnetically susceptible surface, the method comprising the steps of:

a. providing an application/removal assembly for holding and dispensing a first elongated retention device comprising at least one magnetic element;

b. positioning the application/removal assembly proximate to the supporting means, attraction of the retention device for the supporting means causing the retention device to be magnetically attached onto the supporting means so as to secure the recording medium thereto; and c. rotating the supporting means in a first direction causing the retention device to disengage from the application/removal assembly.

14. The method of claim 13 further comprising the step of removing the retention device by:

a. rotating the supporting means in a second direction to engage the retention device with the application/removal assembly; and b. retracting the application/removal assembly from a position proximate from the supporting means thereby removing the retention device from the supporting means.

15. The method of claim 14 wherein (a) the retention device comprises a plurality of discrete magnetic elements separated by interstitial spaces and (b) the application/removal assembly comprises a plurality of projections for engaging the interstitial spaces of the retention device.

16. The method of claim 15 further comprising the step of providing a second elongated retention device for releasable attachment to the supporting means.

17. The method of claim 15 wherein the step of retracting the application/removal assembly comprises progressively detaching the retention device along a direction parallel to the axis of rotation of the supporting means.

18. The method of claim 15 wherein the step of retracting the application/removal assembly comprises progressively detaching the retention device along a direction normal to the axis of rotation of the supporting means.

19. The method of claim 15 further comprising the step of actuating the application/removal assembly such that all portions of the retention device contacting the supporting means are removed from the supporting means substantially simultaneously.

20. Apparatus for securing a printing plate to a plate cylinder, the apparatus comprising:

a. a first elongated retention device for releasable attachment to the plate cylinder proximate to a leading edge of the printing plate;

b. a second elongated retention device for releasable attachment to the plate cylinder proximate to a trailing edge of the printing plate, the retention devices comprising a plurality of discrete magnetic elements separated by interstitial spaces;

c. an application/removal assembly positioned adjacent to the plate cylinder, the application/removal assembly comprising a plurality of projections for engaging the magnetic elements of the first and second retention devices, the plurality of projections of the application/removal assembly being rigidly affixed to a slide base such that when the application/removal assembly holds the retention device, retracting the application/removal assembly from the plate cylinder causes all portions of the retention devices in contact with the supporting means to be removed substantially simultaneously;

d. a motor for rotating the plate cylinder for engaging the first retention device with the application/removal assembly; and e. means for actuating the application/removal assembly toward and away from the plate cylinder for application and removal of the retention devices.

21. Apparatus for securing a printing plate to a plate cylinder, the apparatus comprising:

a. a first elongated retention device for releasable attachment to the plate cylinder proximate to a leading edge of the printing plate;

b. a second elongated retention device for releasable attachment to the plate cylinder proximate to a trailing edge of the printing plate, the retention devices comprising a plurality of discrete magnetic elements, the magnetic elements separated by interstitial spaces;

c. an application/removal assembly positioned adjacent to the plate cylinder, the application/removal assembly comprising a plurality of projections for engaging the magnetic elements of the first and second retention devices, the plurality of projections of the application/removal assembly being slideably attached to a slide plate such that when the application/removal assembly holds the retention device, retracting the application/removal assembly from the plate cylinder causes progressive detachment of the retention devices along a direction parallel to the axis of rotation of the supporting means;

d. a motor for rotating the plate cylinder for engaging the first retention device with the application/removal assembly; and e. means for actuating the application/removal assembly toward and away from the plate cylinder for application and removal of the retention devices.

22. Apparatus for securing a printing plate to a plate cylinder rotatable about an axis, the apparatus comprising:

a. a first elongated retention device for releasable attachment to the plate cylinder proximate to a leading edge of the printing plate;

b. a second elongated retention device for releasable attachment to the plate cylinder proximate to a trailing edge of the printing plate, the retention devices comprising a plurality of discrete magnetic elements separated by interstitial spaces;

c. an application/removal assembly positioned adjacent to the plate cylinder, the application/removal assembly comprising a plurality of projections for engaging the magnetic elements of the first and second retention devices, the plurality of projections of the application/removal assembly being hingedly affixed to a slide base such that rotation of the projections away from the plate cylinder causes progressive detachment of the retention device along a direction normal to the axis of rotation of the supporting means;

d. a motor for rotating the plate cylinder for engaging the first retention device with the application/removal assembly; and e. means for actuating the application/removal assembly toward and away from the plate cylinder for application and removal of the retention devices.

* * * * *